US005289784A

United States Patent [19]

Waibel

[11] Patent Number: 5,289,784

[45] Date of Patent: Mar. 1, 1994

[54] TABLE BASE

[76] Inventor: Walter Waibel, Birkenstr. 19, 8312 Dingolfing, Fed. Rep. of Germany

[21] Appl. No.: 840,066

[22] Filed: Feb. 25, 1992

[30] Foreign Application Priority Data

Mar. 1, 1991 [DE] Fed. Rep. of Germany ..... 4106611

[51] Int. Cl.[5] ..... A47B 3/06

[52] U.S. Cl. ..... 108/157; 108/7; 248/188.1; 248/371

[58] Field of Search ..... 108/151, 154, 155, 156, 108/157, 7; 248/371, 165, 188.1

[56] References Cited

U.S. PATENT DOCUMENTS

| | | | |
|---|---|---|---|
| 2,961,280 | 11/1960 | Jentzen | 108/153 X |
| 3,826,206 | 7/1974 | Ruggles | 108/153 X |
| 4,287,837 | 9/1981 | Bayles | 108/154 |
| 4,422,385 | 12/1983 | Rutsche | 108/153 |
| 4,688,748 | 8/1987 | Pruyser | 248/188.7 |
| 4,711,184 | 12/1987 | Wallin et al. | 108/144 |
| 4,805,538 | 2/1989 | Fisher | 108/7 |
| 4,944,235 | 7/1990 | Jahnke | 108/154 X |
| 5,101,736 | 4/1992 | Bommarito | 108/7 |
| 5,174,532 | 12/1992 | Huang | 108/153 X |

FOREIGN PATENT DOCUMENTS

| | | | |
|---|---|---|---|
| 2250444 | 4/1974 | Fed. Rep. of Germany . | |
| 3625136 | 12/1987 | Fed. Rep. of Germany . | |
| 9011059 | 1/1991 | Fed. Rep. of Germany . | |
| 9013387 | 2/1991 | Fed. Rep. of Germany . | |
| 3231802 | 3/1992 | Fed. Rep. of Germany . | |
| 786497 | 11/1957 | United Kingdom | 108/157 |
| 2025211 | 1/1980 | United Kingdom | 108/154 |

*Primary Examiner*—J. Franklin Foss

*Attorney, Agent, or Firm*—Nixon & Vanderhye

[57] ABSTRACT

A table base (2) features a table substructure (4) and pedestals which can be arranged at its ends. Supporting rails (24) featuring plug-in holes (28, 30, 32, 34) for supporting parts (12, 14) on the pedestal side and for cross-arms (20, 22) on the table base side are arranged parallel to the ends of the table base (2) in the area of connection between the table substructure (4) and the pedestals (6). The connection between the supporting rails (4), the cross-arms (20, 22) on the table base side and the supporting parts (12, 14) on the pedestal side is made in the form of a truss union so that the entire table base (2) is exceptionally stable while having the appearance of a light construction.

21 Claims, 3 Drawing Sheets

TABLE BASE

Figure 1:
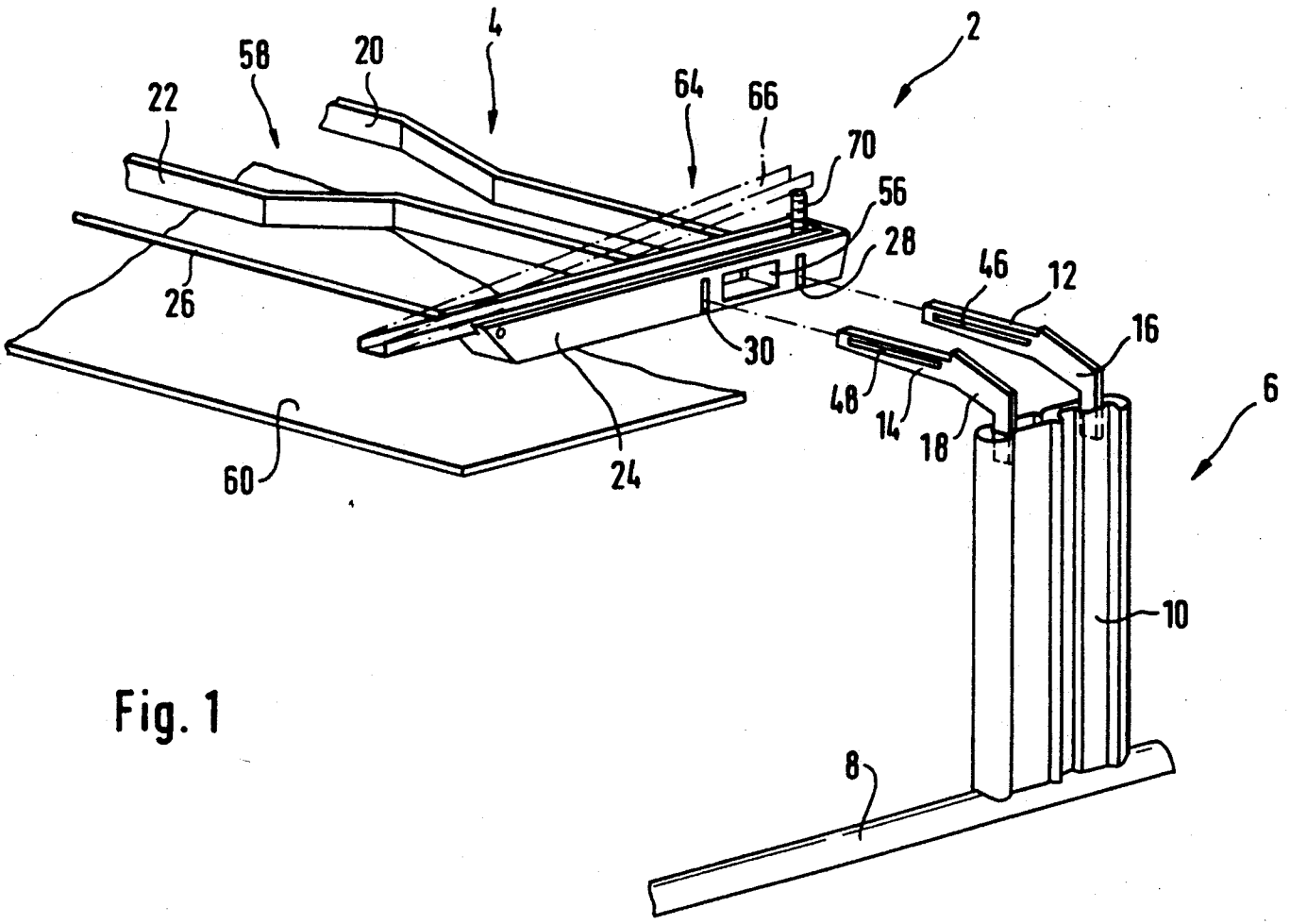

Subject of the invention is a table base, in particular for an office, laboratory or work table, in accordance with the characterizing clause of claim 1.

A table base known from DE-OS 32 31 802 consists essentially of two self-supporting metal top-hat sections arranged in longitudinal direction to the table with their openings facing downward in such a way that horizontally arranged supporting arms from pedestals can be plugged into the open vertical ends of the top-hat sections so that the top-hat sections are supported relative to the floor by the pedestals. The respective table work top must then be fastened to the top of the top-hat sections. Along its longitudinal edges the work top features bead-like rounded edgings which are extended in downward direction so that the top-hat sections forming the table base cannot be seen from the outside, thus lending an aesthetically attractive appearance to the table as a whole.

As the result of the bead-like rounded edgings on its two longitudinal sides the actual table top in DE-OS 32 31 802 displays a very elaborate cross-sectional profile shape and is of considerable material thickness due to the fact that the table top itself contributes a great deal to the stability of the table as a whole. Precisely because of the elaborate profile shape and the considerable thickness of material, the subject of DE-OS 32 31 802 is at a disadvantage when, for example, the table is refitted with a new top because this necessarily incurs a relatively high financial outlay, particularly when local conditions require the table top to be supplied in special sizes, i.e. in lengths that do not conform with the standard sizes. It would be conceivable, of course, to provide the table top with a less elaborate profile shape and to make it thinner. This would mean, however, that the resulting work or office table would not possess a sufficiently high level of stability because a thinner top no longer has enough inherent stability; in addition, with a thinner top it would no longer be possible to conceal the top-hat sections underneath the table behind the bead-like rounded edging so that the table would be optically less attractive on the whole.

Furthermore, fitting a table equipped with or mounted on this table base with motor-driven actuators for adjusting the incline of the table top would be possible within certain restrictions only, if at all. Inclining mechanisms of this type are often demanded, however, particularly for high-grade desks or work tables.

Elevated stability requirements continue to be set for high-grade desks and work tables. Attempts are made to achieve this stability by making the table base as heavy and solid as possible, in addition to which extra bracing measures can also be introduced between the table substructure, the base and the table top. One known method, for example, is to equip the longitudinal side of the table top facing away from the sitting side with a vertically arranged back panel, i.e. a back panel which is vertical to the table top and points in downward direction, as a means of bracing the entire table substructure in longitudinal direction.

Elaborate struts and especially back panels of this type that are fastened to the table top as well as to the table substructure cannot be used on height-adjustable tables for design reasons, because then it would no longer be possible to adjust the table height. Back panels of this type do not generally enjoy much demand any more because they often lend a table thus equipped a heavy and somewhat unwieldy appearance, which is no longer reconcilable with today's design concepts and wishes.

For example, diagonally arranged braces between the table base and the vertical side flanges or legs have the main drawback of not enabling a rolling container or base cabinet to be positioned in the area of these braces and not enabling the full undertable height, i.e. from the floor up to the bottom of the table base, to be used. There is, therefore no optimum utilization of space underneath such tables. Braces of this type also confine foot room under the table.

By contrast, it is the aim of the invention now under consideration to design a table base in accordance with the characterizing clause of claim 1 so that an office, laboratory or work table thus equipped will display high stability with simultaneous optimum utilization of the space available under the table base.

This problem is solved in accordance with the invention by the characteristics quoted in claim 1 and 2.

According to claim 1, the table base has end rails, with supporting parts for connecting vertical pedestals to the table base being fastened in the area of the end rails. The supporting parts of the pedestals are of elongated sword shape and penetrate the end rails. This gives rise, in the manner of a truss joint, to a mutual union of supporting, bracing and connecting structural elements in such a form as to a result in a condition of statically perfect and thus optimum bracing in the direction of the main axes of the table base. Thanks to the design-based union of supporting and bracing elements in this manner there is adequate space available under the table base because no provisions must be made for any additional bracing components.

According to claim 2, the table base has end supporting rails to support the table top, with cross-arms positioned under the table top and arranged in the longitudinal direction of the table top on the one hand and supporting parts for connecting vertical pedestals to the table base on the other hand connected to each other in the area of the end supporting rails. This gives rise here, too, to a mutual union of supporting, bracing and connecting structural elements in the manner of a truss joint and in such a form as to result in a condition of statically perfect and thus optimum bracing in the direction of the three main axes of the table base. Thanks to the design-based union of supporting and bracing elements in this manner there is adequate space available under the table base because no provisions must be made for any additional bracing components.

Advantageous further developments of the invention result from the sub-claims.

It is an advantage that each rail is a U-shaped section with locating holes on one side for cross-arms located on the table base side, with each rail being penetrated by the cross-arms through the locating holes in such a way that the plug-in holes on the cross-arms for the supporting parts of the pedestal come to rest on the opposite side of the rail. Firstly this means that the rails of low dead weight are self-supporting and so make a major contribution to the overall stability of the table base. Secondly, the space existing inside the U-section is ideal for carrying cables and/or motor-driven actuators and similar. Finally, the overall stability of the table base is increased by the type of connection chosen to link the cross-arms to the U-shaped section.

If the cross-arms arranged in longitudinal direction of the table top or the table base are hollow rectangular sections, these cross-arms will display a high level of inherent stability at a relatively low dead weight. This also makes it easy to plug the supporting parts of the vertical pedestals into the cross-arms and to connect them there with the cross-arms.

Furthermore, if the supporting parts of the pedestals can be screw-fitted in the cross-arms, this will result in a releasable and possibly adjustable yet stable connection between the pedestals and the table base.

If, in accordance with a further arrangement, the screw connection between the supporting parts of the pedestals and the cross-arms is made between the two legs of the U-shaped rails, this screw connection will not be visible from the outside on a subsequently fully assembled table, which again contributes favourably to an attractive appearance of the table as a whole.

Using supporting aids positioned in the area of the holes on both sides of the rails it is possible to reinforce the edges of the holes in the rails and so improve the rigidity of the base.

If provision is made here for supporting angles on the inside of the U-shaped rail next to the locating holes set on both sides for the cross-arms on the one hand and the supporting parts of the pedestals on the other hand, this will lead to an additional form-fit anchorage of the cross-arms in the inside of the U-shaped rail, in particular when the legs of the U-shaped section are relatively thin-walled.

Instead of the supporting angles it is possible to make provision for a large number of reinforcement ribs which result in a secure anchorage of the cross-arms on the one hand and an additional bracing of the U-shaped rails on the other hand.

If locating devices are provided in the U-shaped rails for the subsequently mounted table top, these locating devices—like the screw connection between the supporting parts of the pedestals and the cross arms—will not be visible from the outside, which has a positive bearing on the appearance of the table as a whole.

If the locating devices for the table top are designed as profile rails, the table top can be favorably designed as a so-called sliding top.

Furthermore, if the profile rails for guiding the table top can be folded or tilted at the U-shaped rails and so be guided over the entire table base, it will be possible to adjust the incline of the table top.

According to one arrangement option it is possible in this case to provide for a motor-driven incline adjustment mechanism in the area of the U-shaped rails, i.e. in the space between the legs of the U-shaped rails.

Finally, if the rails are made of fibre-reinforced plastic, they will display high stability at low dead weight and can be manufactured with minimum outlay.

Further details, aspects and advantages of the invention under discussion result from the following description which will refer to the drawing.

Figure 2:
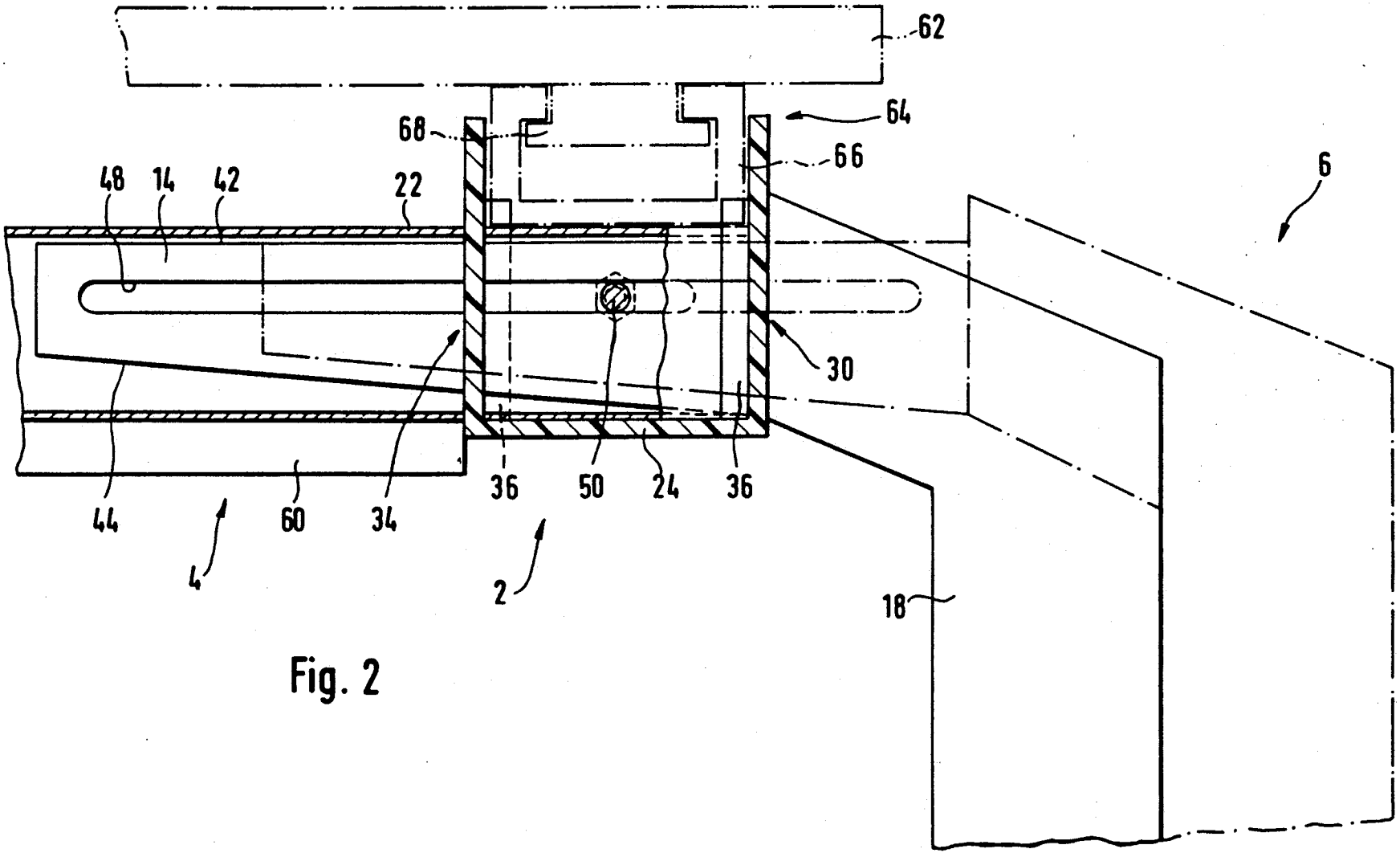

The drawing shows:

FIG. 1: An exploded view of one right-hand side section of a table base in accordance with the invention, illustrative of the connection of the table base with the horizontal supporting parts of a pedestal;

FIG. 2: A cross-sectional side view of a connection union between a cross-arm of the table base, an end rail of the table base and the vertical supporting part of the pedestal; and FIG. 3: A top view of the connection between the table base and the pedestal.

A table base marked throughout the drawing with the number 2 consists essentially of a horizontally arranged table substructure in the form of a frame component 4, on both ends of which it is possible to position vertically arranged pedestals, the pedestals being shown in the drawing as 6. In the illustrated example each pedestal 6 features a transom 8 at the floor end, a vertically arranged frame component 10 and supporting parts 12 and 14. The supporting parts 12 and 14 are of elongated sword shape and are formed on angular supports 16 and 18 which are fastened in turn to the frame section 10. Here there is an advantage in using a height adjustable pedestal so that the vertical position of the supporting parts 12 and 14 relative to the floor transom 8 can be varied. There is a particular advantage in designing the pedestal 6 as described in German patent application P 41 06 610.3 lodged by the same applicant and entitled "Height-adjustable table with linear or straight guide"; full reference is made herewith to the contents disclosed in said patent. The above identified German Patent Application P 41 06 610.3 corresponds to U.S. patent application Ser. No. 07/840,067 titled Height-Adjustable Table with a Linear or Straight Guide, naming as inventor Waibel, Walter, and filed on even date herewith, the subject matter of which is incorporated herein by reference.

The frame component 4 as shown in FIG. 1 consists mainly of two cross-arms 20 and 22 arranged in longitudinal direction of the subsequently mounted table top, as well as end rails which are arranged horizontally and run parallel to the ends of the subsequently mounted table top. Rail 24 is visible and illustrated in FIG. 1. Frame component 4 also possesses a round base that lies parallel to the cross-arms 20 and 22 and which is arranged between the two rails, being fixed in these rails so as not to twist.

Each rail has a U-shaped cross-section, as is best seen in FIG. 2. FIG. 1 shows the two lens of the U-section to have a large number of openings or holes, with two slot-shaped plug-in holes 28 and 30 provided on the side facing pedestal 6, their spacing and dimensions being selected to enable the sword-shaped supporting parts 12 and 14 of frame component 6 to be inserted. In the other leg of the U-section and opposite plug-in holes 28 and 30 there are locating holes 32 and 34 (FIG. 3) for taking cross-arms 20 and 22. As is best seen in FIGS. 2 and 3, the cross-arms 20 and 22 pass through the one leg of the U-section into locating holes 32 and 34 and extend up to the opposite leg of the section into the area of plug-in holes 28 and 30 for supporting parts 12 and 14.

Figure 3:
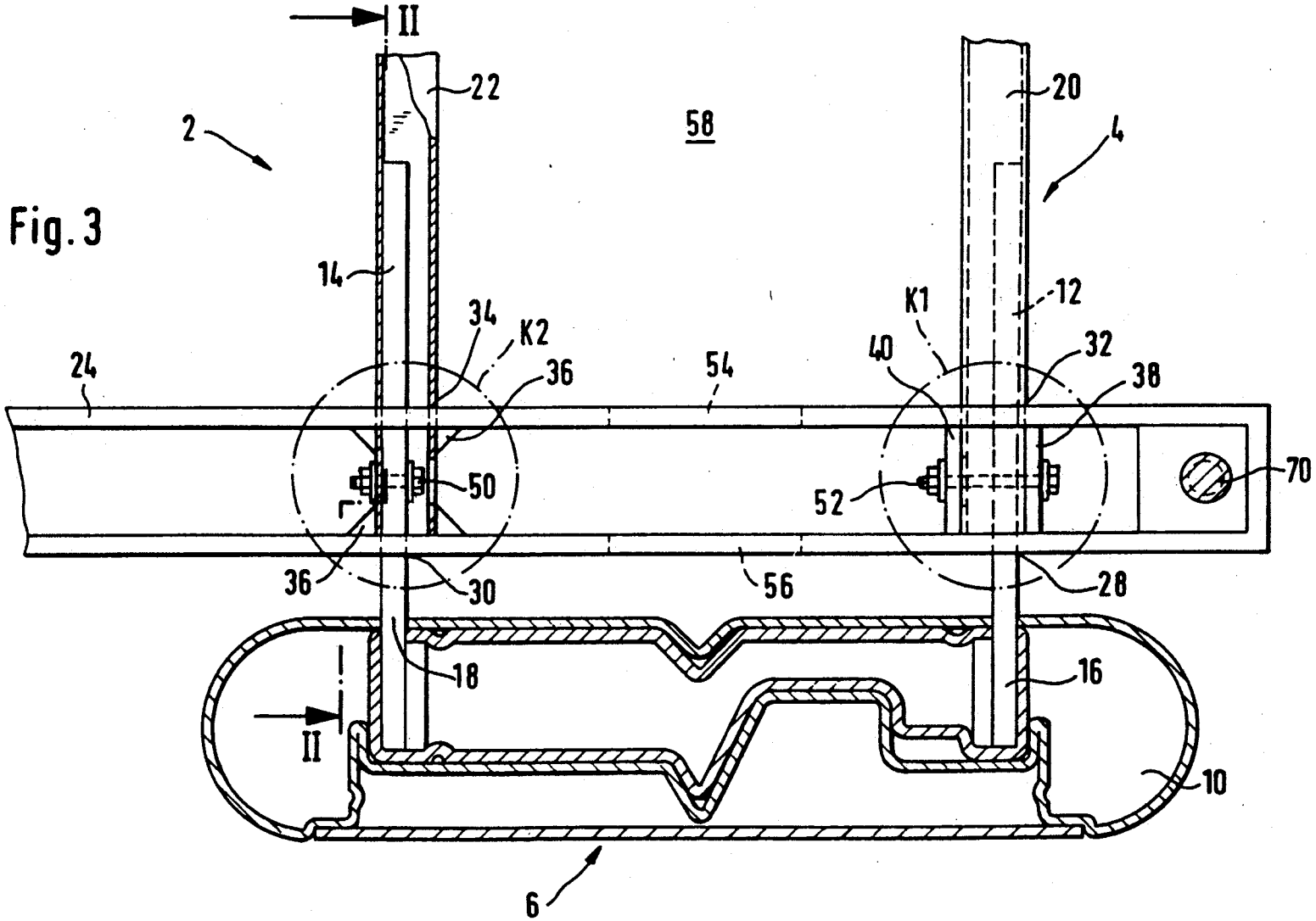

Cross-arms 20 and 22 are guided inside the U-section of rails 24 either by supporting angles 36 on both sides next to the locating holes 32 and 34 and plug-in holes 28 and 30, as illustrated with cross-arm 22 in FIG. 3, or by horizontally arranged reinforcement ribs 38 and 40 inside the U-sections of the rails and likewise on both sides of the plug-in holes 28 and 30 and the locating holes 32 and 34, as illustrated with cross-arm 20 in FIG. 3.

Cross-arms 20 and 22 are joined with rails 24 by welding, bonding or similar in the area of the locating holes 32 and 34, supporting angles 36 or reinforcement ribs 38 and 40. In a particularly favoured arrangement the rails 24 are made of fibre-reinforced plastic, i.e. GFP, or a carbon fibre composite. In this case the cross-arms can be integrated in the material of the rails 24 during the production of these rails.

As can also be seen from FIGS. 2 and 3, the supporting parts 12 and 14 of pedestal 6 penetrate the material of the rails 24 at the plug-in holes 28 and 30 and extend into the inside of cross-arms 20 and 22 which are designed as hollow sections. Each of the supporting parts 12 and 14 are formed accordingly—as already mentioned—into a rectangular sword shape shown in FIG. 2. In the arrangement illustrated by way of example in FIG. 2, each supporting part 12 and 14 also features an additional trapezoidal shaping in longitudinal direction, with a horizontally arranged top edge 42 and a bottom edge 44 that tapers toward the free end of the supporting part. This shape makes it easier to insert the supporting parts 12 and 14 into the plug-in holes 28 and 30 and into the hollow cross-arms 20 and 22 projecting into the area of the plug-in holes 28 and 30. Thanks to the elongated sword shape of the supporting parts 12 and 14, the cross-arms 20 and 22 receive extensive support in the area of the top edge 42 of each supporting part 12 and 14 after the supporting parts 12 and 14 are inserted, resulting in high stability of the entire table base.

As can be seen from FIGS. 1 and 2, each supporting part 12 and 14 possesses an elongated slot-shaped recess 46 and 48. The recesses 46 and 48 accommodate the connecting screws 50 and 52 which pass through appropriately positioned bore holes in the cross-arms 20 and 22 in accordance with FIGS. 2 and 3. If the cross-arms 20 and 22 are braced on the inside of the rails 24 with reinforcement ribs 38 and 40, suitable bore holes must also be provided in the reinforcement ribs 38 and 40 so as to be able to pass through connecting screw 52. The connecting screws 50 and 52 serve to lock the supporting parts 12 and 14 of pedestal 6 inserted in the plug-in holes 28 and 30 in cross-arms 20 and 22, where as the result of the slot-shaped recesses 46 and 48 the position of each pedestal 6 can be varied relative to the rails 24 and hence relative to the frame component 4 by changing the respective plug-in depth of the supporting parts 12 and 14, as is illustrated in FIG. 2 with the dot-dash line. Consequently it is possible, for example, to finely adjust the respective pedestal 6 to the given size of the table top being used, or when the supporting parts 12 and 14 are drawn out a relatively long way it is possible to hang in trays or similar, as is already known from the DE-OS 32 31 802 mentioned at the beginning.

With the supporting parts 12 and 14 having the illustrated elongated shape, the screw connection point between the base or cross-arms 20 and 22 and the supporting parts 12 and 14 grows longer as seen from the front of the base looking toward the centre of the table. This results in a favourable lengthening of the lever arm between the vertical frame component 10 and the ends of the supporting parts lying in the cross-arms. If an additional screw connection is made between the cross arms and supporting parts in the area of the ends of these supporting parts—not detailed in the drawing—this will improve the overall stability of the base considerably. Since the supporting parts 12 and 14 continue to have the cross-sectional shape of a vertically arranged bar, they are particularly resistant to twisting and hence to tilting moments of the base and the subsequently mounted table top.

As can be seen in FIGS. 1 and 2, a larger sized recess 54 and 56 is provided between cross-arms 20 and 22 and between the locating holes 322 and 34 and the plug-in holes 28 and 30 in each leg of the U-section of rail 24. Through these recesses 54 and 56 it is possible to feed cable, power lines or similar from the pedestal 6 into the area of the frame component 4 and/or actuating mechanisms for adjusting the height of the pedestal can be laid from the area of the frame component 4 into the pedestal 6. A particularly favourable arrangement of a height adjustment mechanism is described in DE-GM 90 11 059, to the contents of which full reference is made herewith.

In order to have sufficient space in the area of the frame component 4 between the cross-arms 20 and 22 for locating motor-driven actuators for the height adjustment of table base 2 and in order to be able to accommodate or install surplus lengths of cable, telephone modems, mains transformers and similar in this area, the cross-arms 20 and 22 are elbow shaped as shown in FIG. 1 so that a relatively large space 58 is available between the cross-arms 220 and 22. As the result of their elbow shape, the cross-arms 20 and 22 are also invested with additional stability against deformation.

The entire frame component 4 of the table base 2 can be closed off from the bottom with an appropriately sized bottom panel 60 so that any cables, leads and similar accommodated in the space 58 are kept clean, do not sag and are not accessible from below.

To position and fasten a table top 62 illustrated in FIG. 2 by the dash-double-dot line, each rail 24 has a locating device 64 which is formed by a profiled rail 66 running inside the U-section of the rail 24 in the way shown in FIGS. 1 and 22. Each profiled rail 66 interacts with an accordingly shaped counter-profile 68 on the bottom side of the table top 62 in the way shown in FIG. 2 so that the table top 62 is held but can be moved in the longitudinal direction of the profiled rail 66 and in the longitudinal direction of rail 24. Access to the space 58 formed between the cross-rams 20 and 22 is thus possible from the top by moving the sliding-type table top 62 accordingly along the rails 24. Normally the table top 62 is secured against unintentional sliding along the profiled railed 66 and along the rails 24 by a stop device that is not shown in the drawing. As FIG. 1 indicates, each profiled rail 66 is designed to swivel relative to its corresponding rail 24 in a particularly favourable manner. The swivelling axis of the profiled rails 66 is formed here by the round bar 26 that is arranged parallel to the cross-arms 20 and 22 and which is held twist-free in the rails 24 and about which the profiled rails 66 can rotated, as is shown in FIG. 1. Furthermore, the round bar also acts as a brace between the two rails 24 in the area where the sitting or front edge of the subsequent table will be, yet because of the relatively small diameter of the round bar 26 the bracing is not unduly obtrusive and does not detract from the foot room in this area. In rest position, i.e. with the table top 62 in horizontal arrangement, the bottom sides of the profiled rails 66 sit on the top sides of the cross-arms 20 and 22 arranged inside the rails 24, and with an inclined position of the profiled rails 66 and thus an inclined arrangement of the table top 62 the profiled rails 66 are supported by an appropriate height-adjustment device. It is an advantage for the height adjustment device to be of motor-driven design and for it to engage with a setting spindle 70 at the bottom of each profiled rail. The setting spindle is powered either directly by an electric motor arranged inside the U-section of the rail 24 or by an electrical motor in the space 58. In this case the power transmission between the motor in the space 58 and the setting spindles 70 in the rails 24 is performed to advantage by way of flexible shafts which are laid through appropriate recesses or bore holes into the inside of the rail 24 to the respective setting spindles 70.

The connection between the frame component 4 on the table base side or the table substructure and the end rails 24 with the attached supporting parts 12 and 14 of pedestal 6 is concentrated at two points of union. This together with the relatively large plug-in length of the supporting parts 12 and 14 into the cross-arms 20 and 22 and the rigid integration of the cross-arms 20 and 22 in the rails 24 means that inspite of the light and delicate looking construction of the entire table base 2, the loads and bending moments arising during use are met with a very high level of stability so that an office table, desk or work table designed and equipped with the table base 2 according to the invention is aesthetically attractive and light in design on the one hand yet displays very high stability and good characteristics as regards the damping of oscillations on the other. Since—as can be seen particularly in FIG. 2—no provision must be made for any additional diagonal bracing in the area below the rails 24, e.g. between the pedestals 6 and the bottom panel 60, the entire space underneath the table base 2 and underneath the bottom panel 60 is available to accommodate drawer units, rolling containers or similar, which are able to extend from the floor up to the bottom side of the bottom panel 60 and to the bottom side of the rails 24, thus enabling optimum utilization of the storage space available under the table base.

The description of the invention now under consideration was given in the light of the example arrangement and the drawing; many changes and modifications are possible, however, within the scope of this invention, some of which will be considered now:

It is not essential to design the cross-arms 20 and 22 as hollow sections of rectangular cross-section; depending on the anticipated loads and on the cross-arm material, other shapes of profile or cross-section are possible, e.g. round or oval cross-sections. The design of the supporting parts 12 and 14 must then be adapted accordingly.

It is also possible to fasten the supporting parts 12 and 14 in the cross-arms 20 and 22 by pinning, riveting, welding, bonding or clamping. The screw connection described is particularly advantageous, however, because the connection can then be released/adjusted.

Nor it is essential for the cross-section of the rail(s) 24 to be U-shaped. Other cross-sectional shapes are possible, provided the respective connecting points are adapted accordingly in design.

As described above, the table top 62 is designed as a sliding top. To stop the table top 622 from slipping when the incline is adjusted by a motor-driven actuator with the setting spindle 70, i.e. to stop it from sliding in the profiled rails 66, provision is made for suitable locking. This locking is implemented in a particularly simple yet secure manner by having the top free end of the setting spindle penetrate into the holes in the counter-profile 68 and the profiled rail 66, which align during the lifting operation, before the actual table top lifting operation begins. This way the relative position of the counter profile 68 and the profiled rail 66 is fixed and the table top 62 is locked.

I claim:

1. A table base for a generally rectilinear table comprising:

at least two cross-arms arranged in a longitudinal direction of the table for supporting a table top from below the top;

pedestals for supporting the table top relative to the floor and located at opposite ends of the table, each of said pedestals having generally horizontal arranged supporting parts extending in the longitudinal direction of the table; and rails disposed horizontally and generally parallel to the ends of the table base underlying the table top and having spaced plug-in holes;

the horizontally arranged supporting parts of the pedestal having an elongated sword-like shape for reception in the holes of the rails.

2. A table base according to claim 1 wherein each rail has a generally U-shaped cross-section and locating holes for receiving said cross-arms on one side such that said supporting parts are received through the plug-in and locating holes with said supporting parts and cross-arms being telescopically receivable one within the other.

3. A table base according to claim 1 wherein said cross-arms comprise hollow profiles of rectangular cross-section with said supporting parts being telescopically receivable in said cross-arm profiles.

4. A table base according to claim 1 wherein said supporting parts are connected by screws to said cross-arms.

5. A table base according to claim 4 wherein said rails are generally U-shaped in cross-section having a pair of spaced legs, said screw connections being located between said pair of legs of said U-shaped rail.

6. A table base according to claim 1 wherein said rails are generally U-shaped in cross-section and have a pair of spaced legs, with said plug-in holes in one of said legs and locating holes in another of said legs in alignment with said plug-in holes for receiving said cross-arms and supplemental supporting structure adjacent at least one of said plug-in and locating holes.

7. A table base according to claim 6 wherein said supplemental supporting structure comprises supporting angles on the inside of the U-shaped rail adjacent said holes.

8. A table base according to claim 7 including horizontal reinforcement ribs arranged inside the U-shaped rail between the holes in opposite legs of said rails.

9. A table base according to claim 1 including locating devices for the table top carried by said rails.

10. A table base according to claim 9 wherein said locating devices comprise profiled rails.

11. A table base according to claim 9 wherein the locating devices are arranged to swivel relative to said rails.

12. A table base according to claim 1 including a motor-driven actuator for adjusting the incline of the table top and disposed in the area of the rail.

13. A table base according to claim 1 wherein the rails are formed of fiber-reinforced plastic.

14. A table base for a generally rectilinear table comprising:

at least two cross-arms arranged in a longitudinal direction of the table for supporting a table top from below the top;

pedestals for supporting the table top relative to the floor and located at opposite ends of the table, each of said pedestals having generally horizontally arranged supporting parts extending in the longitudinal direction of the table; and rails for supporting the table top and arranged horizontally and parallel to the ends of the table base, said rails having locating holes for receiving said cross-arms on one side of the rails and plug-in holes for receiving said supporting parts of the pedestal on their opposite sides such that the supporting parts are received through the plug-in and locating holes with said supporting parts and cross-arms being telescopically receivable one within the other.

15. A table base according to claim 14 wherein said supporting rails each have a U-shaped cross-section.

16. A table base according to claim 14 wherein said supporting parts are connected by screws to said cross-arms.

17. A table base according to claim 16 wherein said rails are generally U-shaped in cross-section having a pair of spaced legs, said screw connections being located between said pair of legs of said U-shaped rail.

18. A table base according to claim 14 wherein said rails are generally U-shaped in cross-section and have a pair of spaced legs, with said plug-in holes in one of said legs and locating holes in another of said legs in alignment with said plug-in holes for receiving said cross-arms and supplemental supporting structure adjacent at least one of said plug-in and locating holes.

19. A table base according to claim 18 wherein said supplemental supporting structure comprises supporting angles on the inside of the U-shaped rail adjacent said holes.

20. A table base according to claim 19 including horizontal reinforcement ribs arranged inside the U-shaped rail between the holes in opposite legs of said rails.

21. A table according to claim 14 wherein said cross-arms, said rails and said supporting parts lie in a common plane.

* * * * *